US005579918A

United States Patent [19]

McCurry

[11] Patent Number: 5,579,918

[45] Date of Patent: Dec. 3, 1996

[54] MATERIAL HANDLING CONTAINER

[76] Inventor: Greg McCurry, 609 Jackson Sq., Anderson, S.C. 29625

[21] Appl. No.: 354,661

[22] Filed: Dec. 14, 1994

[51] Int. Cl.[6] ..... B65D 85/66

[52] U.S. Cl. ..... 206/599; 206/600; 206/397; 206/408

[58] Field of Search ..... 206/386, 596, 206/598, 599, 600, 389, 397, 408, 413, 415, 416; 108/54.1, 56.1, 56.3

[56] References Cited

U.S. PATENT DOCUMENTS

| | | | |
|---|---|---|---|
| 3,337,036 | 8/1967 | Peterson | 206/598 |
| 3,502,237 | 3/1970 | Verhein et al. | 206/598 X |
| 4,042,107 | 8/1977 | Kendig | 206/386 |
| 4,151,914 | 5/1979 | Blatt | 206/386 |
| 4,231,475 | 11/1980 | Kessler | 206/408 X |
| 4,401,217 | 8/1983 | Blatt | 206/408 |

*Primary Examiner*—Jacob K. Ackun
*Attorney, Agent, or Firm*—Gerald R. Boss; Cort Flint

[57] ABSTRACT

An adjustable shipping and storage container for handling a roll of material on an elongated core which can be manipulated by a fork lift. The container includes a base unit having a first and second base assembly each having a base member and at least one base floor support element member supporting a respectively base member on a floor. Each base floor support element defines a fork channel underneath the respective base member for receiving a fork of a fork lift enabling the shipping container to be manipulated by a fork lift. The second base assembly is independent from and generally parallel to the first base assembly providing the base unit with variable width capability. Also, the shipping container includes a first and second mounting mechanism carried by the base unit for slidably mounting an end plate to the base unit so that the space between the two end plates may be varied for handling cores of various sizes.

15 Claims, 3 Drawing Sheets

MATERIAL HANDLING CONTAINER

BACKGROUND OF THE INVENTION

This invention relates to a material handling container for shipping and storing manufactured products, and more particularly to a material handling container for storing and shipping rolls of wound fabric or sheets of thin film which are shipped using elongated cores.

In the textile industry, fabric is often shipped in elongated cylindrical rolls utilizing elongated cores. This is also true for the shipping of plastic film. Difficulty arises from the material handling viewpoint in that the sizes of the material being shipped vary in the length of the cores and the width of the rolls. The variations in the material sizes generally depend upon the particular requirements of the customer.

Currently, the elongated rolls are shipped on pallets having fixed lengths and widths. The rolls are positioned in end plates having a central portion for receiving the elongated rolls. The end plates are then are placed on the pallets and secured in place. However, since the rolls vary in length, different sizes of pallets are used to ship the rolls and a large quantity of different size pallets are kept in inventory.

The use of pallets having various sizes is very inconvenient and expensive. To accommodate for the various sizes of rolls which may be required to be shipped, every warehouse may have over 50 different types of pallets on hand having various widths and lengths with numerous quantities of each type of pallet on hand. Accordingly, there is an excessive amount of money tied up in pallets which are on hand solely for a particular size shipping job which may or may not be demanded by a customer. Additionally, the numerous pallets occupy a large area of the warehouse which could be used for more productive purposes.

Some solutions for storing various size rolls have been proposed. U.S. Pat. No. 4,151,914 discloses a shipping and storage container having an open top box structure comprised of blanks which have score lines for folding which may be stapled to one another to define a box of various lengths and widths. However, once the box components are stapled, the box still requires a pallet to be used for handling and transfer of the loaded container. Accordingly, many different size pallets will be required to ship rolls of various lengths.

Also, U.S. Pat. No. 4,042,107 discloses a rigid shipping container for elongated rolls. The rigid shipping container includes a plurality of spaced holes which receive pins connected with end plate assemblies. Accordingly, while the structure would accommodate rolls of different lengths, it is not flexible to accommodate rolls of different widths. Furthermore, the rigid nature of the structure provides for a waste of material when the rolls are greatly smaller than the size of the container.

Accordingly, a need exists for providing a shipping container for shipping and handling rolls of material of different lengths and different widths wound on elongated cores, thereby alleviating the need to have various size pallets for their shipping and handling.

Accordingly, it is an object of the present invention to provide an adjustable shipping container which can ship cylindrical rolls of material of various lengths and widths;

Furthermore, it is an object of the present invention to provide a shipping and storage container that may easily expand in a longitudinal and lateral position for shipping and storing cylindrical rolls of material of different lengths and widths;

Also, it is an object of the present invention to provide a storage and shipping container which may easily be handled by a forklift truck;

Additionally, it is an object of the present invention to provide a storage and shipping container for storing and shipping cylindrical rolls that is easily adjustable in a lateral and longitudinal direction without an excessive waste of materials.

SUMMARY OF THE INVENTION

The above objectives are accomplished according to the present invention by providing an adjustable shipping and storage container for handling materials which may vary in length which can be manipulated by a fork lift. The container includes a base unit having a first and second base assembly each having a base member and at least one base floor support element member supporting a respectively base member on a floor. Each base floor support element defines a fork channel underneath the respective base member for receiving a fork of a fork lift enabling the shipping container to be manipulated by a fork lift. The second base assembly is independent from and generally parallel to the first base assembly providing the base unit with variable width capability. Also, the shipping container includes a first and second mounting mechanism slidably carried by the base unit for adjusting the relative length of the base unit.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
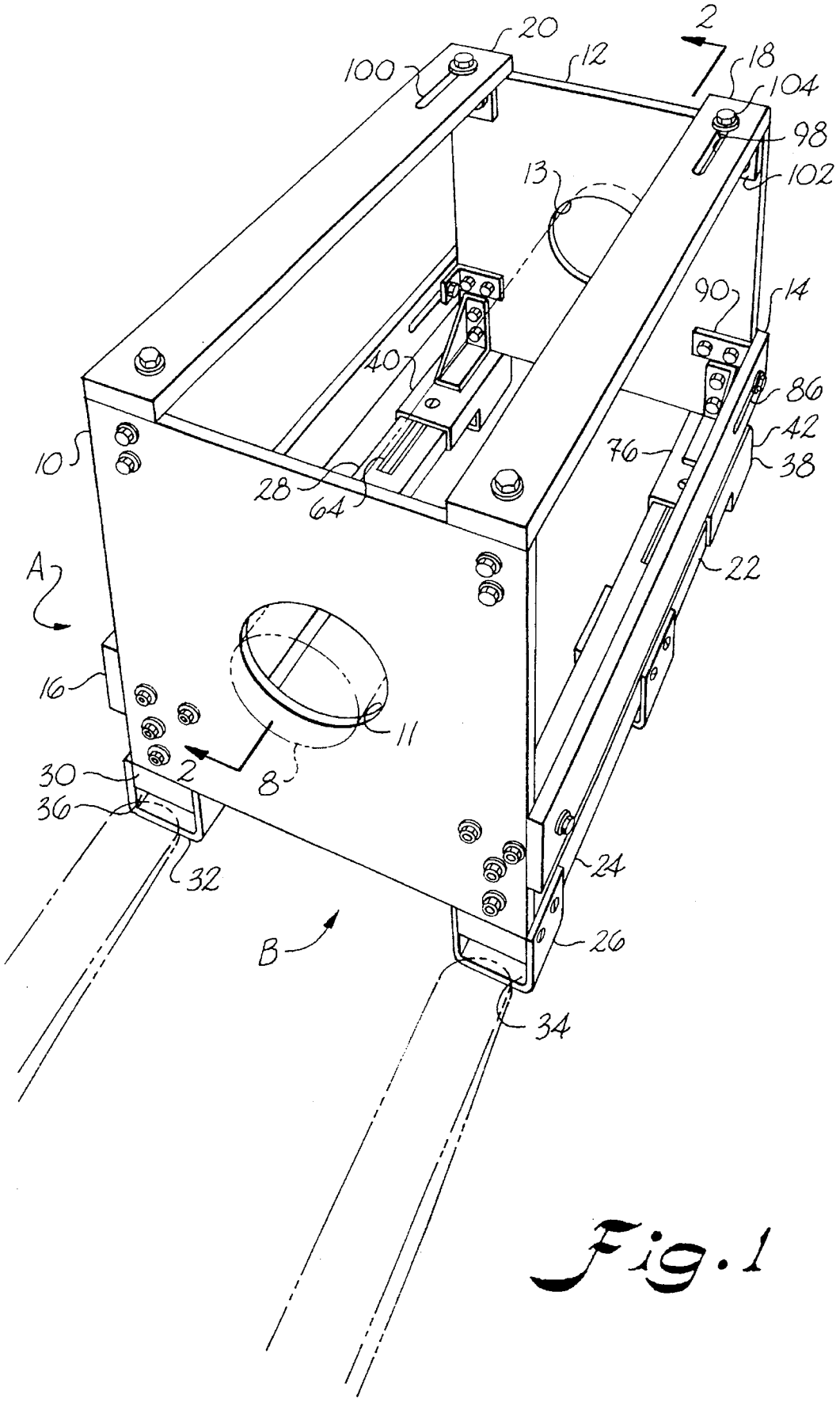
FIG. 1 is a perspective view of a shipping and storage container according to the invention.
Figure 2:
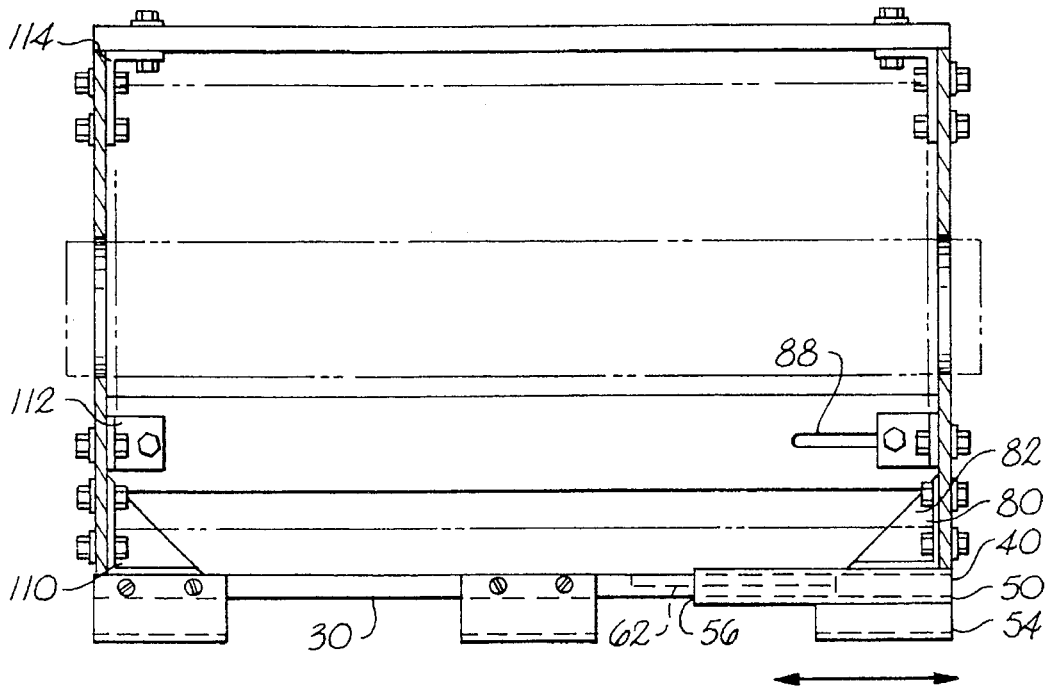
FIG. 2 is a cut-away view taken along line 2—2 of FIG. 1.
Figure 3:
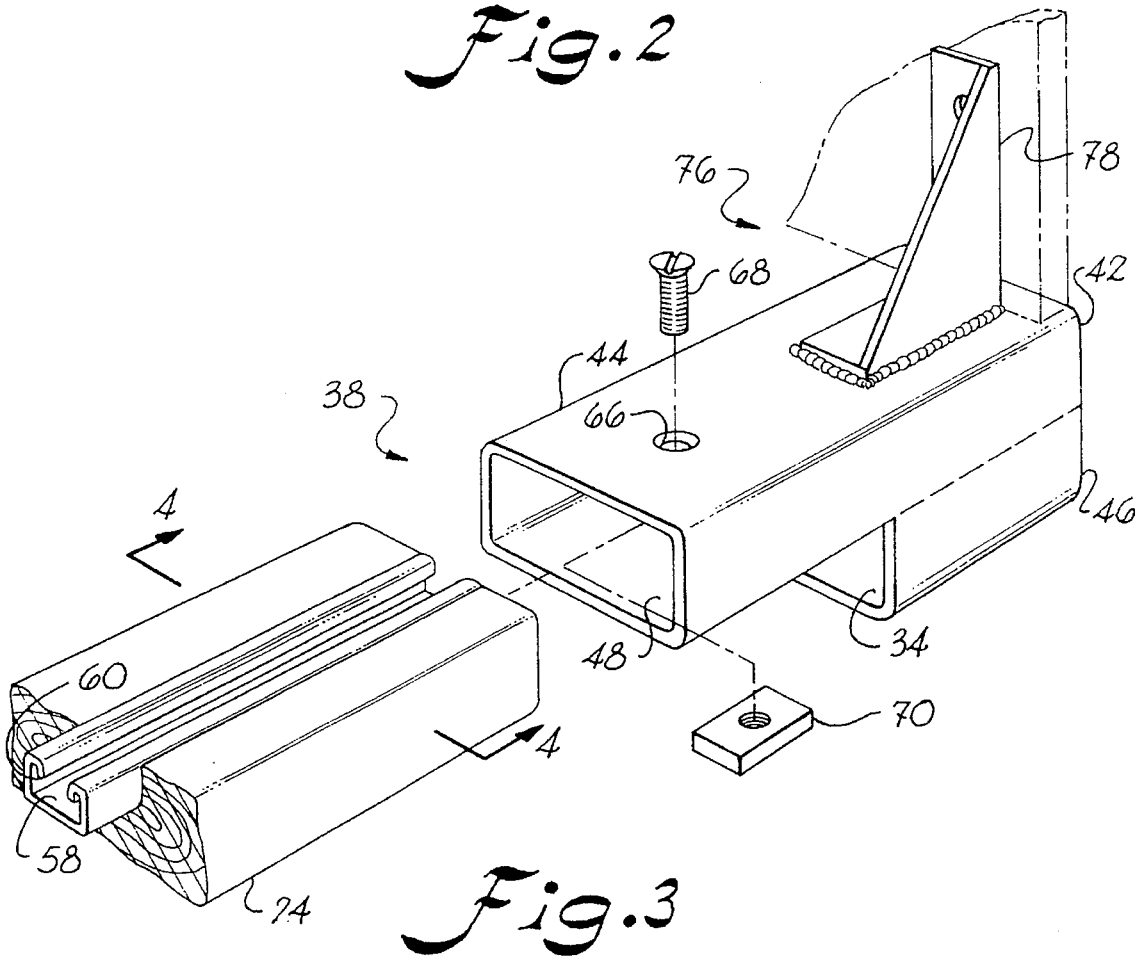
FIG. 3 is perspective view of a stringer extension element according to the invention.
Figure 4:
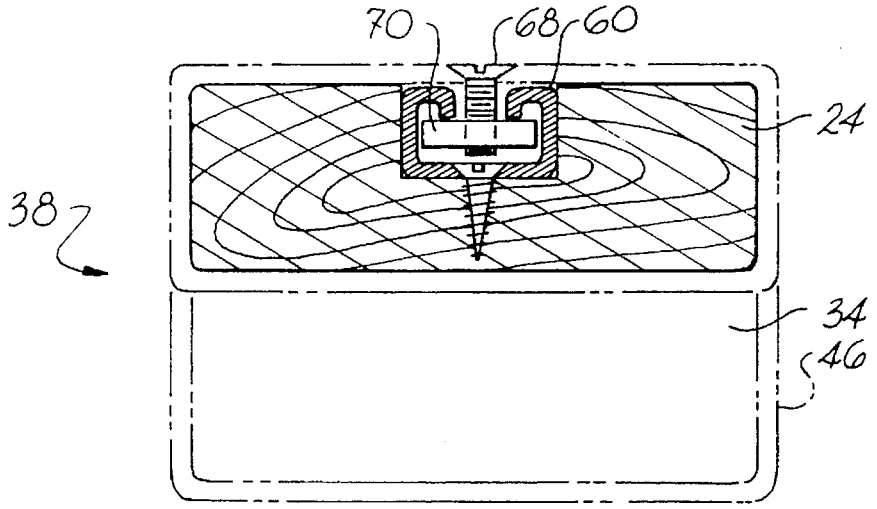
FIG. 4 is a cut-way view taken along line 4—4 of FIG. 3.

Referring now in more detail to the drawings, an adjustable shipping and storage container A is illustrated. FIGS. 1, 2 and 3 illustrate an adjustable shipping and storage container A for handling a roll of material on an elongated core 8 (illustrated in dotted lines) which is handled by a standard fork lift having forks. Container A is comprised of an adjustable base unit B, a first end plate 10 defining a first end plate opening 11 for receiving a first end of elongated core 8 and a second end plate 12 defining a second end plate opening 13 for receiving a second end of the elongated core 8. To provide stability, side support stringers 14 and 16 interconnect end plates 10 and 12 along the sides of container A and a first top support stringer 18 and a second top support stringer 20 interconnect the two end plates along the top of container A.

As shown in FIG. 1, base unit B includes a first base assembly 22 which includes a first base member 24 and at least one first base floor support element 26 supporting first base member 24 on a floor. Second base assembly 28 includes a second base member 30 and at least one second base floor support element 32 supporting second base member 30 on a floor. Second base assembly 28 is separate and independent from first base assembly 22 and runs generally parallel to first base assembly 22. The independent relationship of second base assembly 28 with first base assembly 22 enables container A to be adjustable along its width. In the preferred embodiment, first and second base members are two by four stringers. Accordingly, to accommodate material for shipping having various outside diameters only end plates of various sizes are required to be interchanged while maintaining the same first and second base assemblies.

To enable a fork lift to manipulate container A which has independent base assemblies, first base floor support element 26 defines a first fork channel 34 underneath first base member 22 for receiving a first fork of a fork lift. Also, second base floor support element 32 defines a second fork channel 36 underneath second base member 30 for receiving a second fork of a fork lift. In the preferred embodiment, first base floor support element 26 and second base floor support element 32 each respectively includes at least two support elements having a spacing less than the length of a fork of a fork lift for housing the forks. First and second base floor support elements are of a general U-shaped design which depend from first base member and second base member respectively. The U-shaped design defines the respective fork channel and also provides support for the first and second base members on a floor.

Normally, pallets are used to ship containers and a fork lift engages a lateral component of the pallet for moving a container from a side position. Since one purpose of the invention is to provide adjustability in a lateral direction, container A does not include a lateral support prior to the attachment of end plates 10 and 12. Accordingly, first and second floor support elements provide an essential feature enabling container A to be handled from the side.

As shown in FIGS. 1, 2 and 3, the relative length of base unit B is adjustable. This configuration enables container A to increase its size and volume by adjusting the length of first base member 24 and second base member 30. For adjustability in one embodiment of the invention, first base member 24 slidably carries first stringer adjustment assembly 38 and second base member 30 slidably carries second stringer adjustment assembly 40. First stringer adjustment assembly 38 includes first foot element 42 having sleeve 44 and first foot floor support element 46 which further defines first fork channel 34. Sleeve 44 is of sufficient height and width to receive first base member 24. Sleeve 44 includes a hollow mouth 48 for receiving an end of first base member 24. Second stringer adjustment assembly 40 includes second foot element 50 having sleeve 52 and second foot floor support element 54 which further defines second fork channel 36. Sleeve 52 is of sufficient height and width to receive second base member 30. Sleeve 52 includes second base member mouth 56 for receiving an end of second base member 30.

To provide slidable adjustment of the length, first base member 24 includes a first base slot 58 having a rail 60 and second base member 30 includes a second base slot 62 having a rail 64. Base slots 58 and 62 may be standard unitstruts. Slots 58 and 62 may be any length but in the preferred embodiment they are approximately 24 inches long. First foot element 42 having first guide pin hole 66 is slidably mounted with respect to first base member 24. First guide pin 68 which may be a screw is received within first guide pin hole 66 and first base slot 58. First guide pin 68 is slidably maintained within first base slot 58 by first guide lock 70 which may be a nut. Second foot element 50 is similarly carried by second base member 30.

Accordingly, in operation, the end of first base member 24 which includes first base slot 58 will be received within hollow mouth 48. First guide pin 68 is placed within first guide pin hole 66 and first guide lock 70 is secured to first guide pin 68. First base slot 58 is aligned with first guide lock 70 and first guide lock 70 is received by first base slot 58 below rail 60. In this manner, first foot element 82 can freely move along first base slot 58. When the desired combined length of first base member 24 and first foot element 42 is reached for shipping and storing an elongated cylindrical roll, first foot element 42 is locked into place by first guide lock 70 engaging rail 60. In the preferred embodiment first guide lock 70 is a nut and first guide pin 68 is a screw for securing first foot element 42 in place. Second base member 30 and second foot element 50 are similarly attached as first base member 24 and first foot element 42.

By providing base unit B with adjustability in both a longitudinal and latitudinal direction with the means for handling by a fork lift, base unit B may be used with any horizontal member such as a plywood board for supporting any material for shipping.

As shown in FIGS. 1, 2 and 3 in the preferred embodiment, base unit B is used for shipping rolls of material wound on an elongated core. First end plate 10 having a first end plate opening 11 receives a first end of core 8 and second end plate 12 having a second end plate opening 13 receives a second end of core 8. For handling cores of different lengths, second end plate 12 is slidably attached to base unit B. In the first embodiment, as shown in FIGS. 1, and 3 second end plate 12 is attached to first base member 24 by first mounting mechanism 76 slidably carried by first base member 24. First mounting mechanism 76 includes first stringer adjustment assembly 38 and first foot mounting bracket 78 integral with first stringer adjustment assembly 38 on one end and carried by second end plate 12 at another end. In the first embodiment illustrated in FIG. 3, first foot mounting bracket 78 is permanently attached to first foot element 42 and is temporarily affixed to second end plate 12 by bolts. Second end plate 12 is similarly attached to second base member 30 utilizing second mounting mechanism 80. Second mounting mechanism 80 includes second stringer adjustment assembly 40 slidably attached to second base member 30 and second foot mounting bracket 82. A first end of second foot mounting bracket 82 is attached to second end plate 12 and a second end of second foot mounting bracket 82 is attached to second foot element 50. By attaching first and second foot mounting brackets 78 and 82 to first and second foot elements 42 and 50 respectively, first and second foot mounting brackets 78 and 82 are slidably mounted with respect to first and second base members. Accordingly, when first and second foot elements 42 and 50 are free moving within first base slot 58 and second base slot 62 respectively, second end plate 12 may be positioned at a desired distance apart from first end plate 10 to accommodate an elongated cylindrical core of a length within the range of base unit B in an extended and non-extended position.

As shown in FIG. 1, with second end plate 12 being slidably mounted with respect to base unit B, second end plate 12 must also be slidably mounted with respect to first side support stringer 14 and second side support stringer 16. Accordingly, first side support stringer 14 has first side slot 86 and second side support stringer 16 has second side slot 88 which extend through the width of support stringers 14 and 16 respectively. First L-shaped side brace 90 is mounted on second end plate 12 having a hole (not shown) for receiving first side support bolt 92 which passes through first side slot 86 securing second end plate 12 with first side support stringer 14. Both first side slot 86 and second side slot 88 are respectively located on the ends of first side support stringer 14 and second side support stringer 16 which are above first foot element 42 and second foot element 50. First side slot 86 and second side slot 88 are of a length approximately equal to the length of first base slot 58 and second base extension slot 62 respectively enabling second end plate 12 to slide in relationship with first and second side support stringers 14 and 16 along a proportionate length as second end plate 12 slides with respect to base unit B. In this design, second end plate 12 may be secured with first end plate 10 at any length which base unit B can be adjusted.

Also, as shown in FIG. 1, first top support stringer 18 and second top support stringer 20 include first top slot 98 and second top slot 100 which extend through the width of top support stringers 18 and 20 respectively. Third L-shaped side brace 102 is mounted on second end plate 12 having a hole (not shown) for receiving first top support bolt 104 which passes through first top slot 98 securing second end plate 12 with first top support stringer 18. Both first top slot 98 and second top slot 100 are respectively located on the ends of first top support stringer 18 and second top support stringer 20 which are above first foot element 42 and second foot element 50. First top slot 98 and second top slot 100 are of a length approximately equal to the length of first base slot 58 and second base slot 62 respectively enabling second end plate 12 to slide in relationship with first and second top support stringers 18 and 20 along a proportionate length as second end plate 12 slides with respect to base unit B. In this design, second end plate 12 may be secured with first end plate 10 at any length which base unit B can be adjusted.

As shown in FIG. 2, first base brace 110 connects first end plate 10 with second base member 30. A similar brace (not shown) attaches first end plate 10 with first base member 24. Also, fifth L-shaped brace 112 attaches first end plate 10 with second side support stringer 16. A similar L-shaped brace (not shown) attaches first end plate 10 with first side support stringer 14. Additionally, sixth L-shaped brace 114 attaches first end plate 10 with second top support stringer 18. A similar L-shaped brace (not shown) attaches first end plate 10 with first top support stringer 18. In this manner each of the supporting stringers i.e. base, side and top, are secured on one side to first end plate 10 and slidably attached to second end plate 12 enabling second end plate 12 to be positioned at a desired distance apart from first end plate 10 according to the length of the elongated cylindrical roll being shipped or stored.

In the embodiment shown in FIGS. 1, 2, 3 and 4, first and second base members are flush with end plates 10 and 12. Accordingly, the space required to ship an elongated cylindrical roll of a given length is generally no more than the length of the roll with no excessive space being required by container A.

Figure 5:
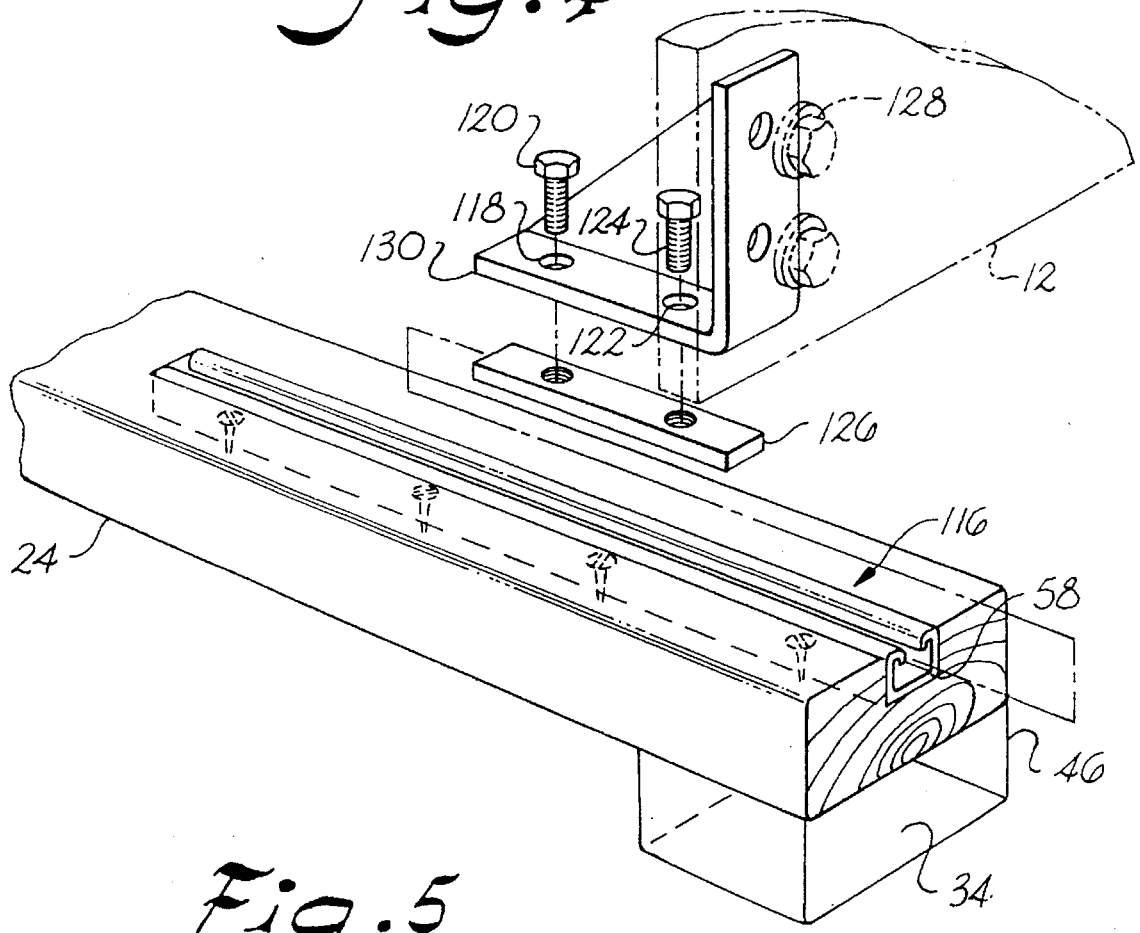
FIG. 5 is another embodiment of a variable length base element according to the invention.

FIG. 5 shows an alternative embodiment for slidably attaching second end plate 12 to base unit B. In this embodiment, first mounting mechanism 116 includes first bracket assembly 130 slidably carried by first base member 24. The first end of first bracket assembly 130 includes first guide pin hole 118 which receives first guide pin 120 and second guide pin hole 122 which receives second guide pin 124. Both first and second guide pins 120 and 124 are preferably bolts. Lock 126, which is preferably a nut, is received within first base slot 58 and first and second guide pins 120 and 124 are secured to lock 126. The second end of first bracket assembly 130 is secured to second end plate 12 by bolts 128. Accordingly, in operation, second end plate 12 is slidably attached to first base member 24. First base slot 58 is aligned with lock 126 and first lock 126 is received by first base slot 58 below rail 60. In this manner, first bracket assembly 130 can freely move along first base slot 58 thereby adjusting the relative length of first base member 24. When the desired distance between first and second end plates 10 and 12 is reached, first bracket assembly 130 is locked into place by tightening first and second guide pins 120 and 124 engaging lock 126 with rail 60. Second base member 30 and second end plate 12 are similarly slidably attached.

Thus it can be seen that a more advantageous container for shipping and storing elongated cylindrical rolls and the like may be had according to the invention. By providing a container that is adjustable in a lateral and longitudinal direction, cylindrical rolls of various lengths and outside diameter dimensions may be shipped utilizing a standard container. By providing a flexible container, the need for a large inventory of fixed size pallets or other fixed sized shipping containers is eliminated enabling a manufacturing facility to operate with less containers and components in inventory reducing inventory costs.

While a preferred embodiment of the invention has been described using specific terms, such description is for illustrative purposes only, and it is to be understood that changes and variations may be made without departing from the spirit or scope of the following claims.

What is claimed is:

1. An adjustable shipping and storage container for handling a roll of material on an elongated core, said container for handling by a fork lift; said container comprising:

a first base assembly having a first base member and at least one first base floor support element member supporting said first base member on a floor;

said first base floor support element defining a fork channel underneath said first base member for receiving a first fork of said fork lift;

a second base assembly having a second base member and at least one second base floor support element supporting said second base member on a floor;

said second base floor support element defining a fork channel underneath said second base member for receiving a second fork of said fork lift;

said second base assembly being independent from and spaced generally parallel to said first base member assembly, said second base assembly in conjunction with said first base assembly defining a base for supporting said core;

a first end plate carried by and extending generally upward from said base, said first end plate having a first end plate opening for receiving a first end of said elongated core for suspending said elongated core above said base;

a second end plate carried by and extending generally upward from said base, said second end plate having a second end plate opening for receiving a second end of said elongated core for suspending said elongated core above said base;

said first and second base members being unconnected except by said first and second end plates;

whereby the spacing between said first base member and said second base member may be varied at a desired distance to adjust to the outside diameter of said material wound on said core.

2. The container of claim 1 including a first mounting mechanism slidably carried by said first base member and carried by said second end plate for slidably mounting said second end plate to said first base member, and a second mounting mechanism slidably carried by said second base member and carried by said second end plate for slidably mounting said second plate to said second base member.

3. The container of claim 2 wherein said first mounting mechanism includes a first stringer adjustment assembly comprising a first foot element slidably carried by said first base member and a first foot mounting bracket integral with said first foot element, said first foot mounting bracket interconnecting said second end plate with said first foot element; and said second mounting mechanism includes a second foot element slidably carried by said second base member and a second foot mounting bracket integral with said second foot element, said second foot mounting bracket interconnecting said second end plate with said second foot element foot.

4. The container of claim 3 wherein said first foot element includes a hollow mouth for receiving said first base member and said second foot element includes a hollow mouth for receiving said second base member.

5. The container of claim 3 including a first foot floor support element depending from said first foot element for supporting said first foot element on a floor and further defining said first fork channel, and also including a second foot floor support element depending from said second foot element for supporting said second foot element on a floor and further defining said second fork channel.

6. The container of claim 3 wherein said container includes said first base member having a first base slot, a first locking means carried by said first mounting mechanism, said first locking means received by said first base slot for locking said first foot element at a selected location, and said second base member including a second base slot, a second locking means carried by said second mounting mechanism, said second locking means received by said second base slot for locking said second foot element at a selected location.

7. The container of claim 3 wherein each of said foot elements are of a length between twenty-five inches and thirty inches providing said base with an adjustable length.

8. The container of claim 2 wherein said first base member includes a first base slot and said first mounting mechanism includes a bracket assembly integral with said second end plate slidably received within said first base slot enabling said second end plate to move independently from said first base member; and said second base member includes a second base slot and said second mounting mechanism includes a bracket assembly integral with said second end plate slidably received within said second base slot enabling said second end plate to move independently from said second base member.

9. The container of claim 1 including a first side support member and a second side support member, said first and second end plates each respectively having a first side and a second side, said first side support member connecting said first sides of said first and second end plates respectively, and said second side support member connecting said second sides of said first and second end plates respectively.

10. The container of claim 9 wherein said first side support member includes a first side slot, said second end plate being slidably mounted with respect to said first side slot for moving along a predetermined distance of said first side support member, and said second side support member includes a second side slot, said second end plate being slidably mounted with respect to said second side slot for moving along a predetermined distance of said second side support member.

11. The container of claim 1 including a top support member, said first and second end plates each respectively having a top side, said top support member connecting said top side of said first and second end plates respectively, said top support member including a top slot, said second end plate being slidably mounted with respect to said top slot for moving along a predetermined distance of said top support member.

12. An adjustable base unit for a shipping and storage container having a horizontal member, said base unit for handling by a fork lift; said base unit comprising:

a first base assembly having a first base member and at least one first base floor support element member supporting said first base member on a floor;

said first base floor support element defining a first fork channel underneath said first base member for receiving a first fork of said fork lift;

a first stringer adjustment assembly comprising a first foot element slidably carried by said first base member having a first foot floor support element supporting said first foot element on a floor and further defining said first fork channel;

a second base assembly having a second base member and at least one second base floor support element supporting said second base member on a floor;

said second base floor support element defining a second fork channel underneath said second base member for receiving a second fork of said fork lift;

said second base assembly being independent from and spaced generally parallel to said first base member assembly, said second base assembly in conjunction with said first base assembly defining a base for supporting said core;

a second foot element slidably carried by said second base member having a second foot floor support element supporting said second foot element on a floor and further defining said second fork channel;

whereby said first and second base assembly may be spaced apart to accommodate horizontal members of various widths yet able to be handled by a fork lift utilizing said first and second fork channels.

13. The base unit of claim 12 wherein:

said first base member including a first base slot and a first mounting mechanism having a bracket assembly slidably received within said first base slot, said bracket assembly for interconnecting with said horizontal member; and said second base member including a second base slot and a second mounting mechanism having a bracket assembly slidably received within said second base slot for interconnecting with said horizontal member.

14. The base unit of claim 12 wherein said first foot element includes a hollow mouth for receiving said first base member and said second foot element includes a hollow mouth for receiving said second base member.

15. The base unit of claim 12 wherein said container includes:

said first base member having a first base slot, a first locking means carried by said first stringer adjustment assembly, said first locking means received by said first base slot for locking said first foot element at a selected location, and said second base member including a second base slot, a second locking means carried by said second stringer adjustment assembly, said second locking means received by said second base slot for locking said second foot element at a selected location.

* * * * *